US011060217B2

(12) United States Patent
Rees et al.

(10) Patent No.: US 11,060,217 B2
(45) Date of Patent: Jul. 13, 2021

(54) KNITTING RING

(71) Applicant: Coating Systems, Inc., Thayne, WY (US)

(72) Inventors: Kim H. Rees, Thayne, WY (US); David A. Rupp, Salt Lake City, UT (US)

(73) Assignee: Coating Systems, Inc., Thayne, WY (US)

( * ) Notice: Subject to any disclaimer, the term of this patent is extended or adjusted under 35 U.S.C. 154(b) by 127 days.

(21) Appl. No.: 16/568,135

(22) Filed: Sep. 11, 2019

(65) Prior Publication Data

US 2021/0071328 A1 Mar. 11, 2021

(51) Int. Cl.
*D04B 3/04* (2006.01)

(52) U.S. Cl.
CPC ..... *D04B 3/04* (2013.01)

(58) Field of Classification Search
CPC ... D04B 3/00; D04B 3/02; D04B 3/04; D04B 3/06
USPC ..... 66/1 A
See application file for complete search history.

(56) References Cited

U.S. PATENT DOCUMENTS 1,208,085 A * 12/1916 Branley ..... 242/153
1,243,162 A * 10/1917 Gruman ..... 242/149
1,282,953 A * 10/1918 Sauer ..... 242/157 R
D59,449 S * 10/1921 Abate ..... D3/18
2,133,221 A * 10/1938 White ..... D04B 3/00 242/157 R
2,142,608 A * 1/1939 Hockert ..... D04B 3/00 242/149
2,155,753 A * 4/1939 Cook ..... A01K 89/015 43/4
2,172,074 A * 9/1939 Thulin ..... D04B 3/00 242/149
2,226,982 A * 12/1940 Sherman ..... D04B 3/00 242/153
2,244,903 A * 6/1941 Walk ..... D04B 3/00 242/153
2,313,684 A * 3/1943 Thulin ..... D04B 3/00 242/149
2,434,609 A * 1/1948 Coffey ..... D04B 3/00 242/150 R
2,472,702 A * 6/1949 Greenstein ..... D04B 3/00 242/149
2,513,851 A * 7/1950 Dodds ..... A41H 31/00 24/3.1
2,524,157 A * 10/1950 Beirer ..... D04B 3/00 66/125 R
2,828,900 A * 4/1958 Le Roy ..... D04B 3/00 24/561
4,037,433 A * 7/1977 Weber ..... D04B 3/04 66/1 A
4,370,870 A * 2/1983 Kroh ..... D04B 3/00 66/1 A (Continued)

*Primary Examiner* — Danny Worrell
(74) *Attorney, Agent, or Firm* — Kirton McConkie; Brian Tucker

(57) ABSTRACT

A knitting ring can be worn on a knitter's finger and used to hold and tension yarn while the knitter is knitting. The knitting ring includes a finger member that secures the knitting ring to the knitter's finger and a yarn member that tensions one or more strands of yarn. The yarn member can include a number of posts around which the strands of yarn can be routed to create a desired degree of tensioning.

20 Claims, 8 Drawing Sheets

(56) References Cited

U.S. PATENT DOCUMENTS

| | | | | | |
|---|---|---|---|---|---|
| 4,713,947 | A * | 12/1987 | Collins | D04B 33/00 | 242/147 R |
| 4,991,410 | A * | 2/1991 | Donatelli | D04B 3/04 | 223/106 |
| D326,241 | S * | 5/1992 | Kroh | 63/1.12 | |
| 5,125,245 | A * | 6/1992 | Kuwabara | D04B 3/04 | 16/225 |
| 7,325,553 | B2 * | 2/2008 | Sievers | A61C 15/046 | 132/323 |
| 2020/0299875 | A1 * | 9/2020 | Rees | D04B 3/04 | |
| 2021/0071328 | A1 * | 3/2021 | Rees | D04B 3/04 | |

* cited by examiner

KNITTING RING

CROSS-REFERENCE TO RELATED APPLICATIONS

N/A

BACKGROUND

Many different knitting techniques exist. Brioche knitting, for example, is used to create ridged fabrics using slipped stiches in conjunction with yarnovers. Brioche knitting can be performed using a one-pass technique or a two-pass technique as those of skill in the art would understand. With both of these brioche techniques, it is possible to use two different strands of yarn which are typically different colors. Stranded knitting is another type of knitting technique that may involve two different strands of yarn.

With any knitting technique, it is common for the knitter to hold and possibly tension the yarn in his or her fingers. Many different techniques and even devices have been developed for this purpose. Even so, many knitters find it difficult, if not impossible, to hold the strands of yarn while performing certain knitting techniques. This is particularly true when the knitting employs two strands of yarn.

BRIEF SUMMARY

The present invention extends to a knitting ring that can be worn on a knitter's finger and used to hold and tension yarn while the knitter is knitting. The knitting ring includes a finger member that secures the knitting ring to the knitter's finger and a yarn member that tensions one or more strands of yarn. The yarn member can include a number of posts around which the strands of yarn can be routed to create a desired degree of tensioning.

In one embodiment, the present invention is implemented as a knitting ring that includes a finger member that secures the knitting ring to a knitter's finger and a yarn member that is coupled to the finger member. The yarn member includes a plurality of posts that are spaced apart to thereby allow one or more strands of yarn to be selectively routed around one or more of the plurality posts to tension the one or more strands of yarn to a desired degree.

In another embodiment, the present invention is implemented as a knitting ring that includes a finger member that secures the knitting ring to a knitter's finger and a base member coupled to the finger member. The base member has a base plate and a plurality of posts that extend from the base plate. The plurality of posts are spaced apart to thereby allow one or more strands of yarn to be selectively routed around one or more of the plurality posts to tension the one or more strands of yarn to a desired degree.

In another embodiment, the present invention is implemented as a knitting ring that includes a finger member that secures the knitting ring to a knitter's finger and a yarn member coupled to the finger member. The yarn member includes a base plate, a top plate and a plurality of posts that extend between the base plate and the top plate. The plurality of posts are spaced apart to thereby allow one or more strands of yarn to be selectively routed around one or more of the plurality posts to tension the one or more strands of yarn to a desired degree.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
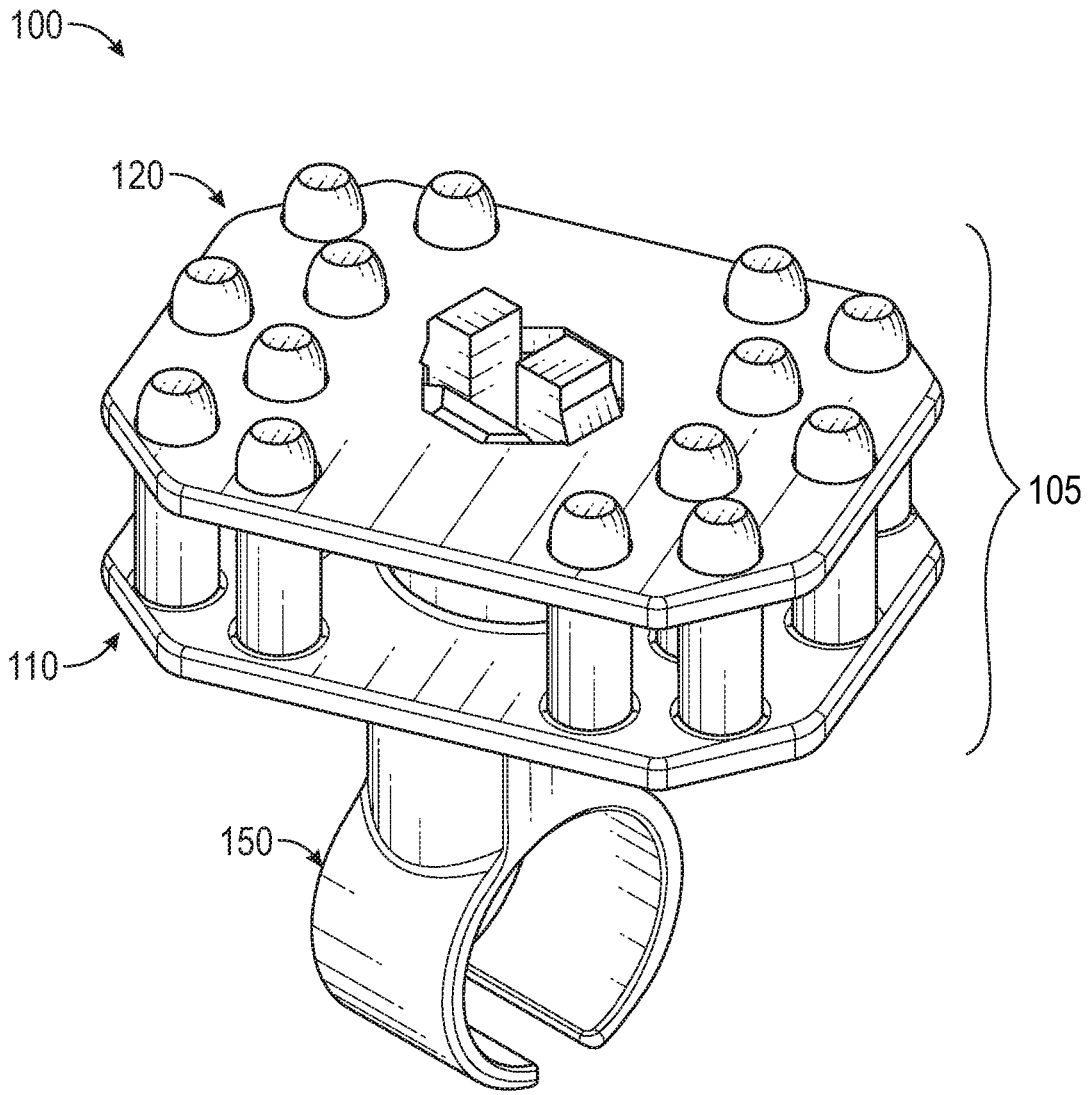
FIGS. 1A-1D illustrate various views of a knitting ring that is configured in accordance with one or more embodiments of the present invention.
Figure 1B:
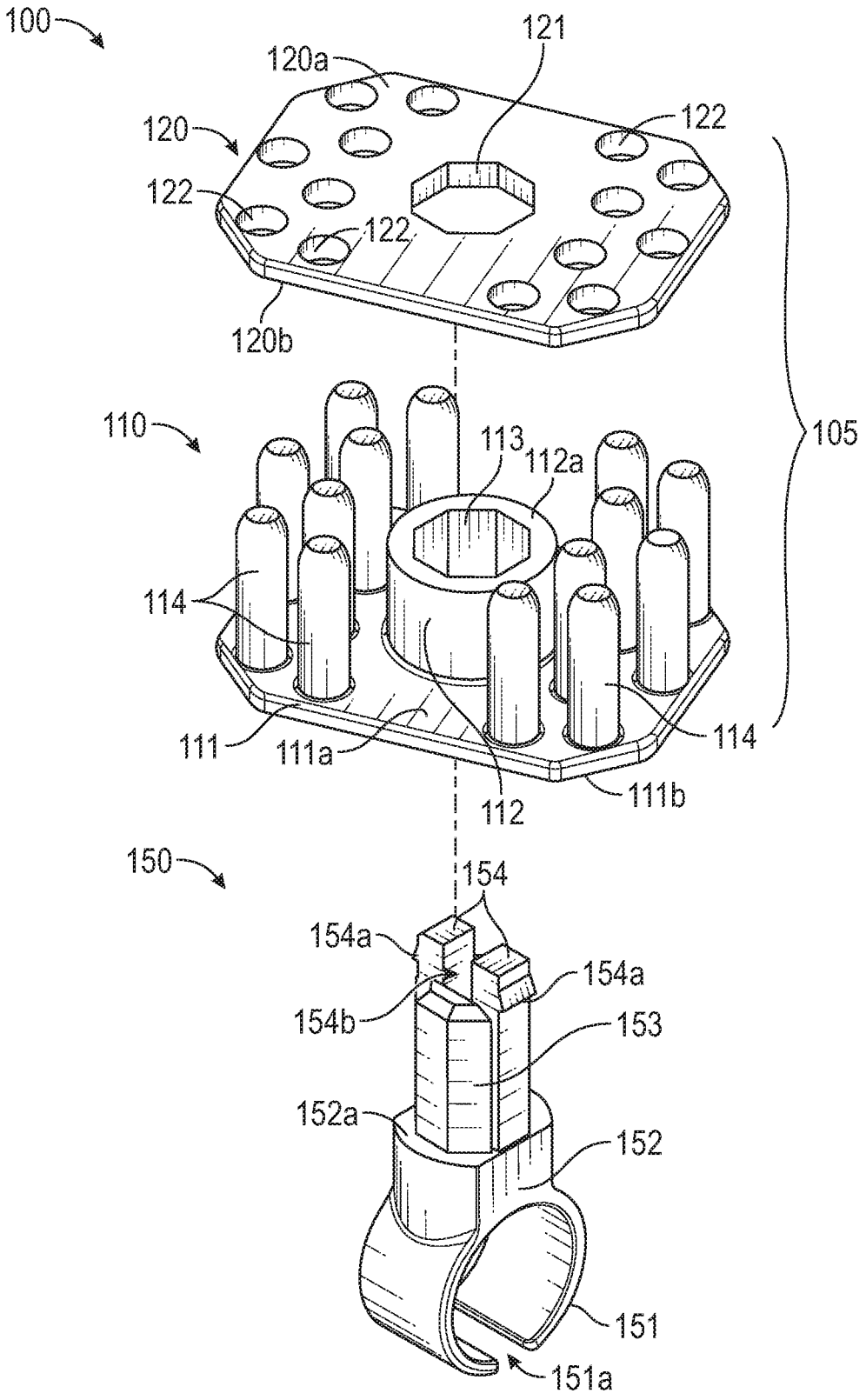

FIGS. 1A and 1B illustrate an assembled view and an exploded view respectively of a knitting ring 100 that is configured in accordance with one or more embodiments of the present invention. Knitting ring 100 includes a yarn member 105 and a finger member 150. In this specification, the term "yarn" should encompass strands of any type of fiber or material that can be used to knit. In some embodiments, knitting ring 100 can be formed of nylon or another plastic-based material that is substantially rigid but sufficiently elastic to perform the functions described below. However, knitting ring 100 could be formed of any suitable material.

As shown in the assembled view of FIG. 1A, finger member 150 couples to yarn member 105 to enable a knitter to wear knitting ring 100 on his or her finger. Yarn member 100 functions to tension the yarn while the knitter is knitting and is configured to enable the knitter to selectively set the degree of tensioning.

With reference to the exploded view of FIG. 1B, finger member 150 includes a ring portion 151 into which the knitter inserts his or her finger. Ring portion 151 can include a notch 151*a* to accommodate fingers of different sizes. Finger member 150 also includes a coupling member 152 that protrudes from the outer surface of ring portion 151 to form a surface 152*a*. Prongs 153 and 154 extend upwardly from surface 152*a* and may be positioned centrally within surface 152*a* such that a portion of surface 152*a* extends outwardly beyond at least some of the outer surfaces of prongs 153 and 154. In some embodiments, such as the depicted embodiments, finger member 150 includes two prongs 153 which are in the form of non-locking prongs and two prongs 154 which are in the form of locking prongs having tabs 154*a*. Prongs 153 may be positioned on opposing sides of coupling member 152 and spaced apart to form a gap 154*b*. Prongs 154 may be positioned within gap 154*b* and spaced apart so that prongs 154 may pivot towards one another as will be further described below. The combined outer surfaces of prongs 153 and 154 may form an octagonal or other multisided shape to prevent rotation of finger member 150 relative to yarn member 100 while these members are coupled together.

Yarn member 105 includes a base member 110 and a top plate 120 both of which interconnect with finger member 150. Base member 110 includes a base plate 111 that has a generally rectangular shape forming a top surface 111*a* and a bottom surface 111*b*. In this context, the terms "top" and "bottom" are used only to distinguish between the two opposing surfaces of base plate 111 and do not necessarily mean that top surface 111*a* will be facing upward during use of knitting ring 100. A flange 112 extends from top surface 111*a* and forms an edge 112*a*. A prong channel 113 is formed within flange 112 and extends from bottom surface 111*b* through edge 112*a* to thereby allow prongs 153 and 154 to extend therethrough. Prong channel 113 may have an inner surface that forms the same octagonal or other multisided shape as the outer surfaces of prongs 153 and 154 to thereby prevent finger member 150 from rotating when prongs 153 and 154 are inserted through prong channel 113. When prongs 153 and 154 are inserted through prong channel 113, bottom surface 111*b* contacts and rests on surface 152*a* of coupling member 152.

Figure 1C:
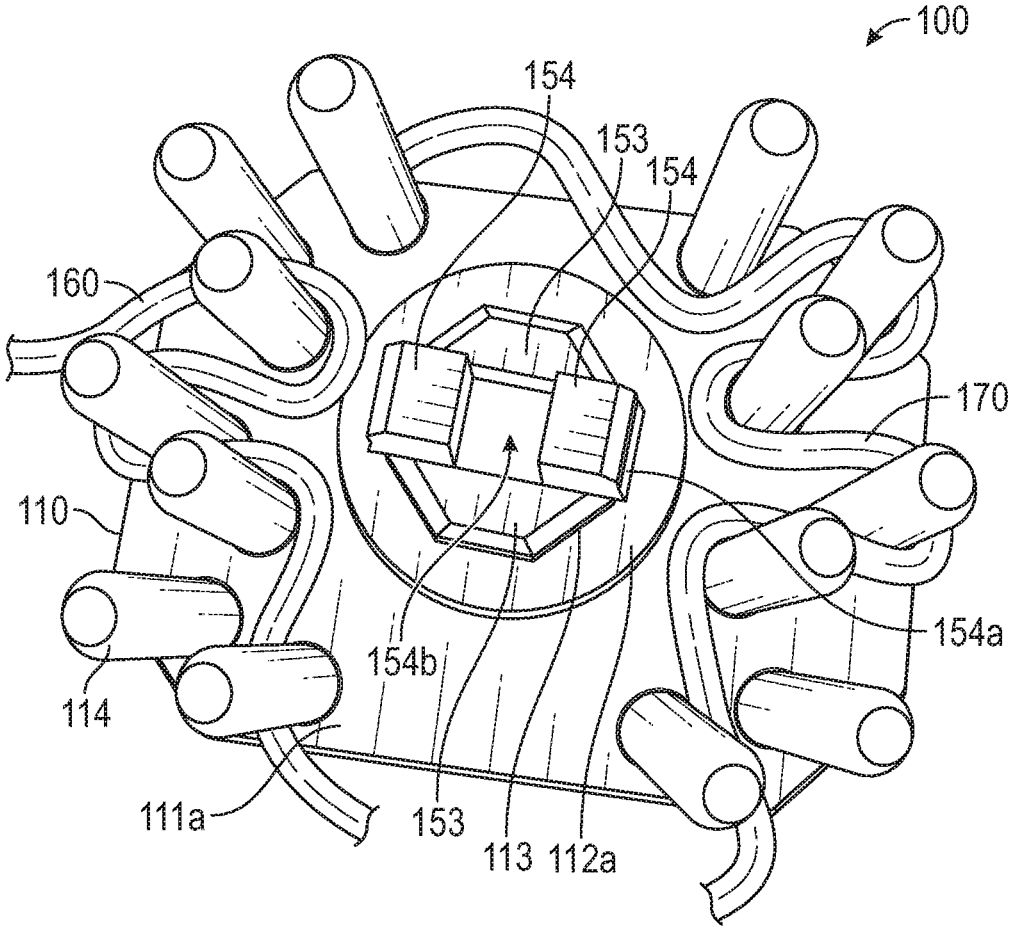

Base member 110 also includes a plurality of posts 114 which extend from and are spaced apart along top surface 111*a*. In this specification and the claims, the term "post" should be construed as any structure that extends from a surface. Accordingly, a post need not have an elongated, cylindrical shape. In some embodiments, such as the depicted embodiments, flange 112 and posts 114 extend perpendicularly from top surface 111*a*. Also, in some embodiments, such as the depicted embodiments, flange 112 can be centered within top surface 111*a* and opposing sets of posts 114 can be symmetrically positioned on opposite ends of top surface 111*a*. However, in other embodiments, flange 112 may be offset from the center of top surface 111*a* and posts 114 may be spaced in any manner across top surface 111*a*. As is best seen in FIG. 1C, in some embodiments, posts 114 may be positioned in offset rows to allow yarn to be wrapped around the posts in a zig-zag pattern. In some embodiments, the outer surface of posts 114 may have a texture that increases the amount of friction between the post and yarn to thereby facilitate the tensioning of the yarn. In some embodiments, posts 114 may be cylindrical such as is shown in the figures, while in other embodiments, posts 114 may have a multisided or some other non-continuous outer surface that causes an increased amount of friction to be applied to the yarn.

Top plate 120, which may, but is not required to, have the same or similar rectangular shape as base plate 111, forms a top surface 120*a* and a bottom surface 120*b*. A prong opening 121 and a plurality of post openings 122 are formed through top plate 120 and are positioned to align with prong channel 113 and posts 114 of base member 110. As a result, top plate 120 can be coupled to base member 110 and finger member 150 by inserting posts 114 through post openings 122 and prongs 153 and 154 into/through prong opening 121. As they insert through prong opening 121, prongs 154 can pivot inwardly until tabs 154*a* clear top surface 120*a*. Prongs 154 can then pivot outwardly thereby placing tabs 154*a* over top surface 120*a* to prevent top plate 120 from unintentionally detaching. Bottom surface 120*b* contacts edge 112*a* of flange 112 to maintain a spacing between top plate 120 and base plate 111. When top plate 120 is coupled in this manner, posts 114 can at least extend into post openings 122 and may extend completely through and beyond post openings 122.

FIG. 1C, which provides a top view of knitting ring 100 when top plate 120 is removed, illustrates how this configuration of knitting ring 100 enables yarn to be tensioned to various degrees. In this figure, a first strand of yarn 160 has been wrapped around a set of posts 114 on the left side of knitting ring 100 while a second strand of yarn 170 has been routed around a set of posts 114 on the right side of knitting ring 100. The degree to which each of strands 160 and 170 will be tensioned is generally dependent on the number of posts 114 around which each strand is routed. The degree of tensioning can also be influenced by the angle at which strands 160 and 170 are routed around posts 114. Accordingly, the knitter has many different options for routing strands 160 and 170 around posts 114 and can therefore selectively control the degree of tensioning for a particular type of yarn, a particular project, a particular knitting technique, personal preference, etc.

Figure 1D:
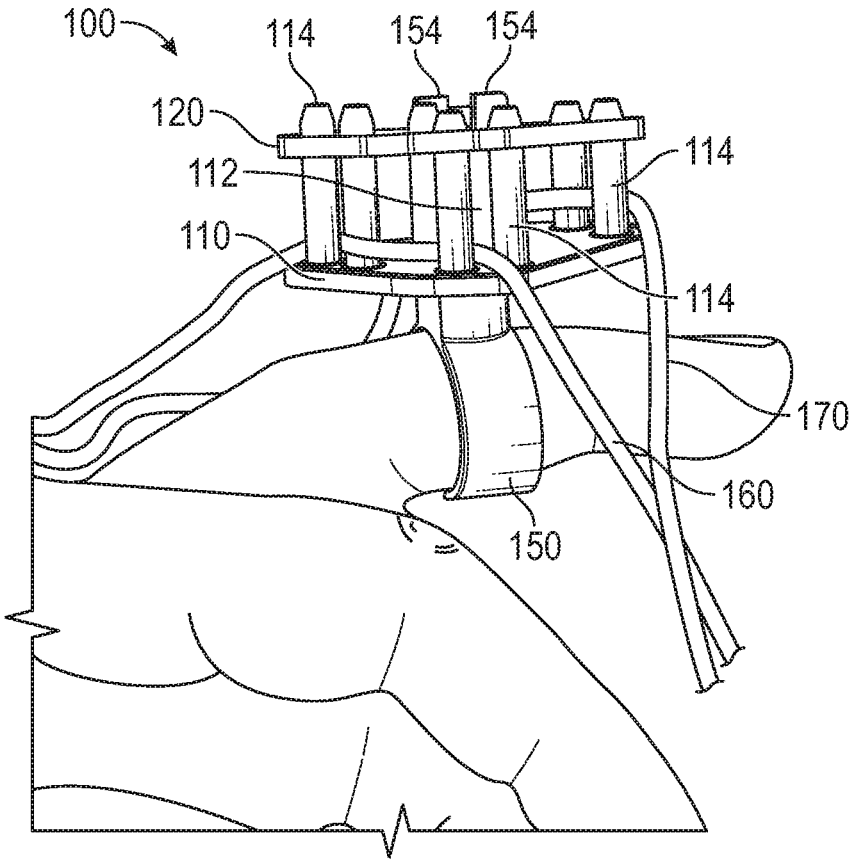

FIG. 1D shows knitting ring 100 when worn on the knitter's finger. As shown, strands of yarn 160 and 170 extend through yarn member 105 between base plate 111 and top plate 120 and are routed around a number of posts 114. This routing tensions the portion of strands 160 and 170 that extends between knitting ring 100 and the project that is being knitted.

Although FIGS. 1A-1D illustrate embodiments where base plate 111 and top plate 120 have a generally rectangular shape, in other embodiments, base plate 111 and top plate 120 could have any other suitable shape such as a square shape, a diamond shape, a hexagonal shape, a circular shape, an oval shape, etc. Also, although finger member 150 is shown as being separable from base member 110, in some embodiments, finger member 150 and base member 110 may be formed as a single component. Additionally, in some embodiments, prongs 153 and 154 could form part of base member 110 as opposed to forming part of finger member 150. Furthermore, in some embodiments, flange 112 could be formed on top plate 120 (e.g., could extend from bottom surface 120*b*) as opposed to extending from base plate 111. In short, a number of variations could be made to the depicted and described examples of the present invention.

FIGS. 2A-2E illustrate another embodiment of a knitting ring 200 that is substantially similar to knitting ring 100 except that yarn member 105 provides a "two-story" arrangement. Additionally, knitting ring 200 represents an embodiment that has a circular shape.

Figure 2A:
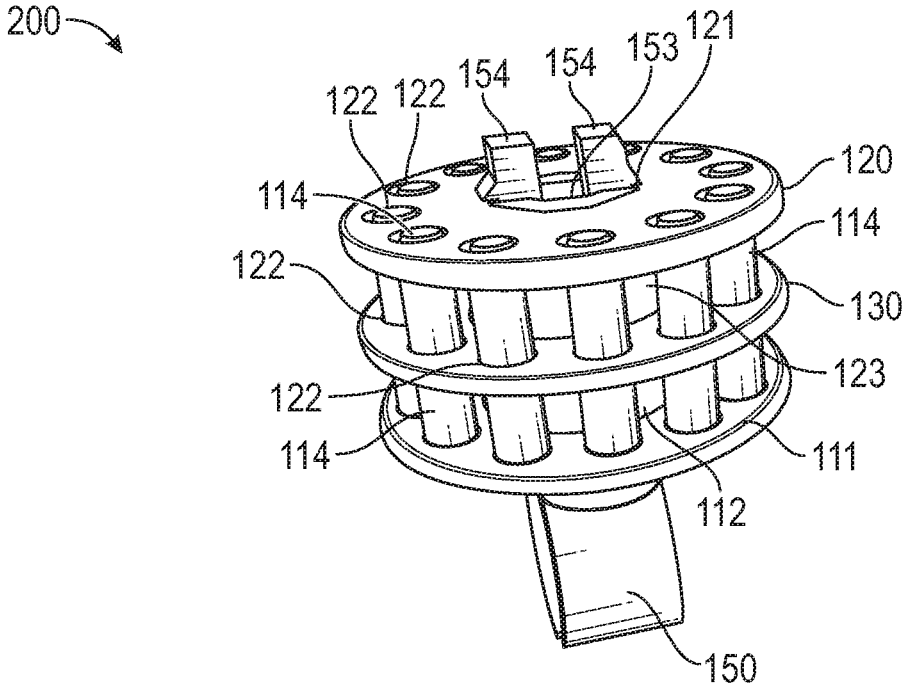
FIGS. 2A-2E illustrate various views of another knitting ring that is configured in accordance with one or more embodiments of the present invention.
Figure 2B:
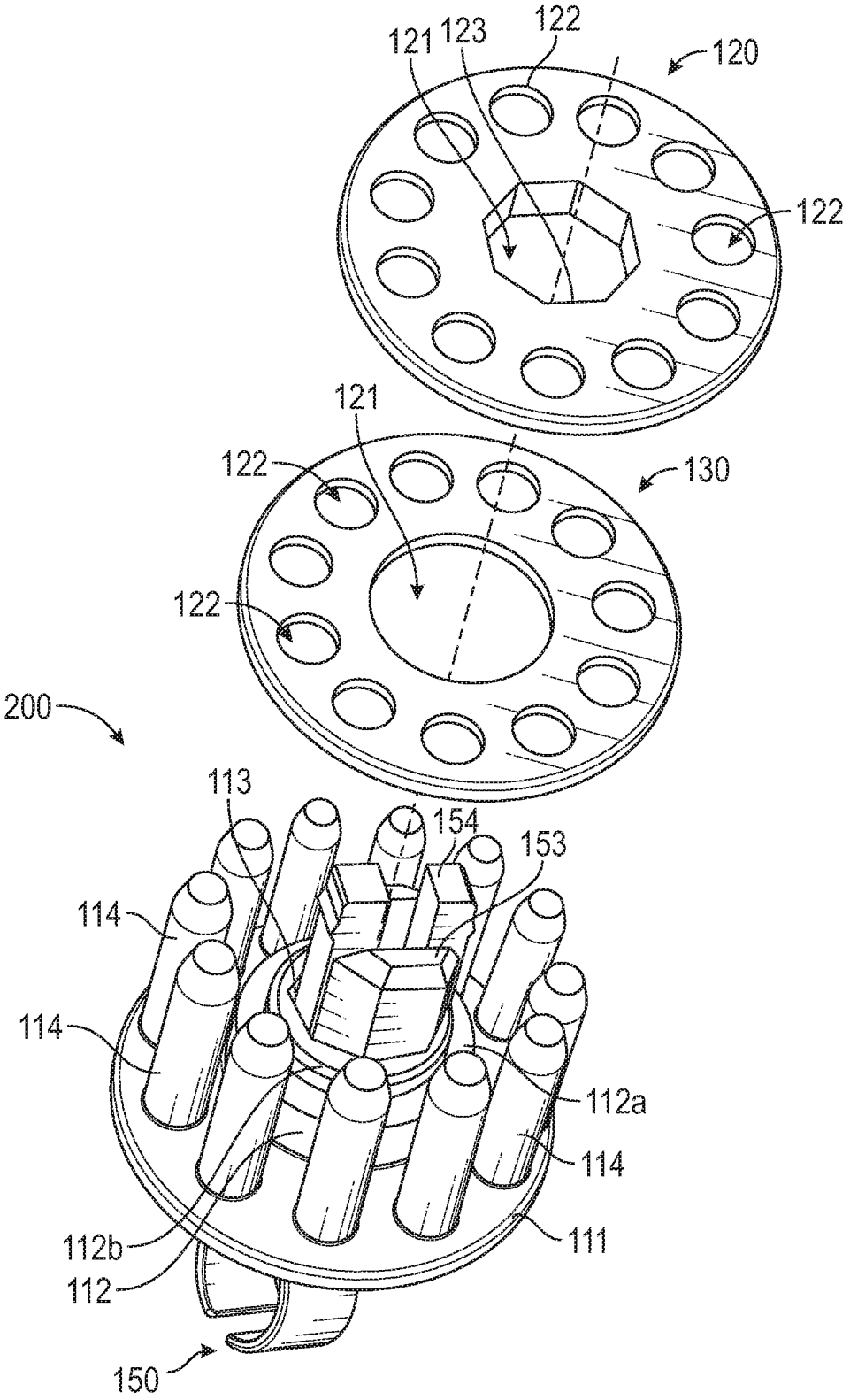
Figure 2C:
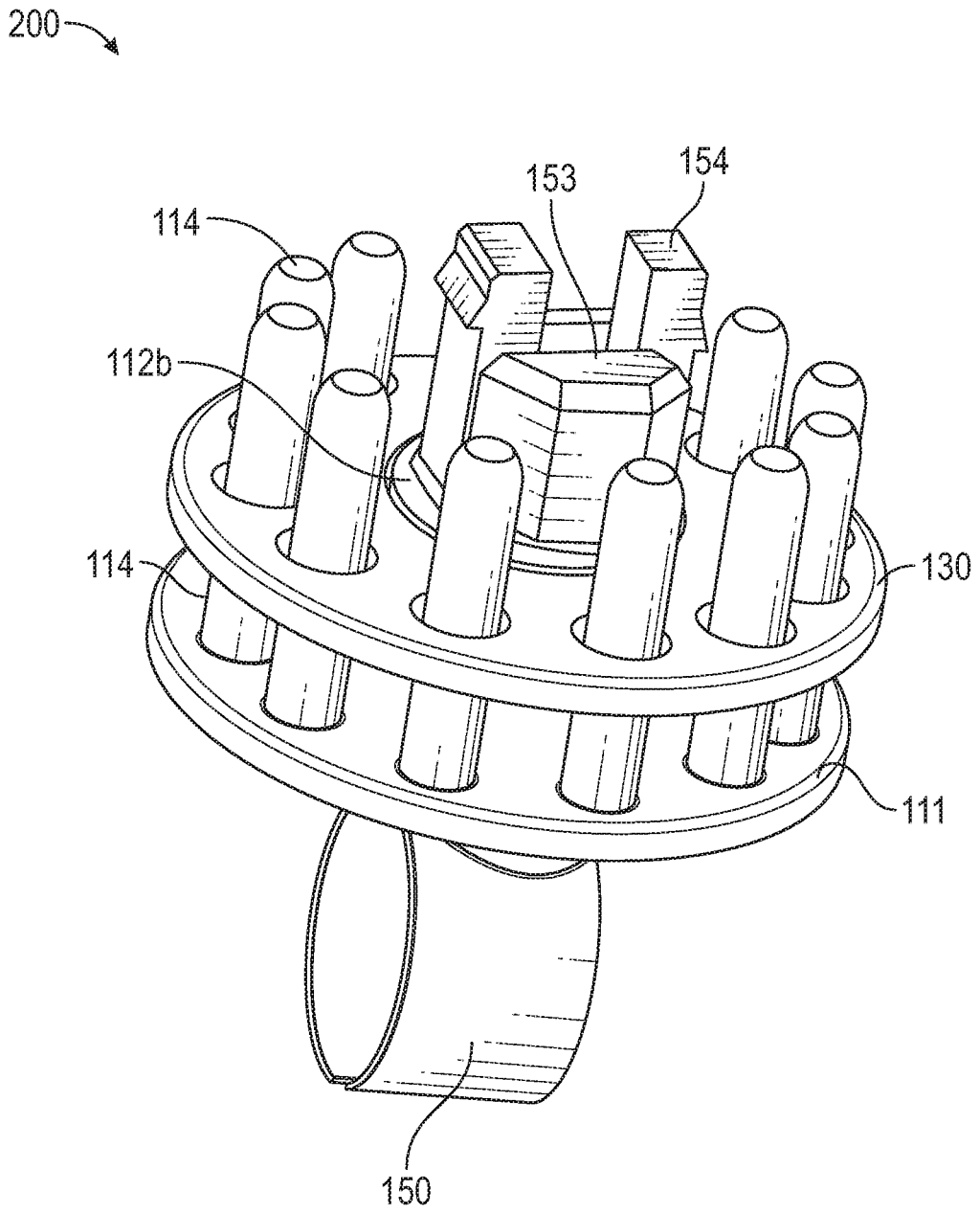
Figure 2D:
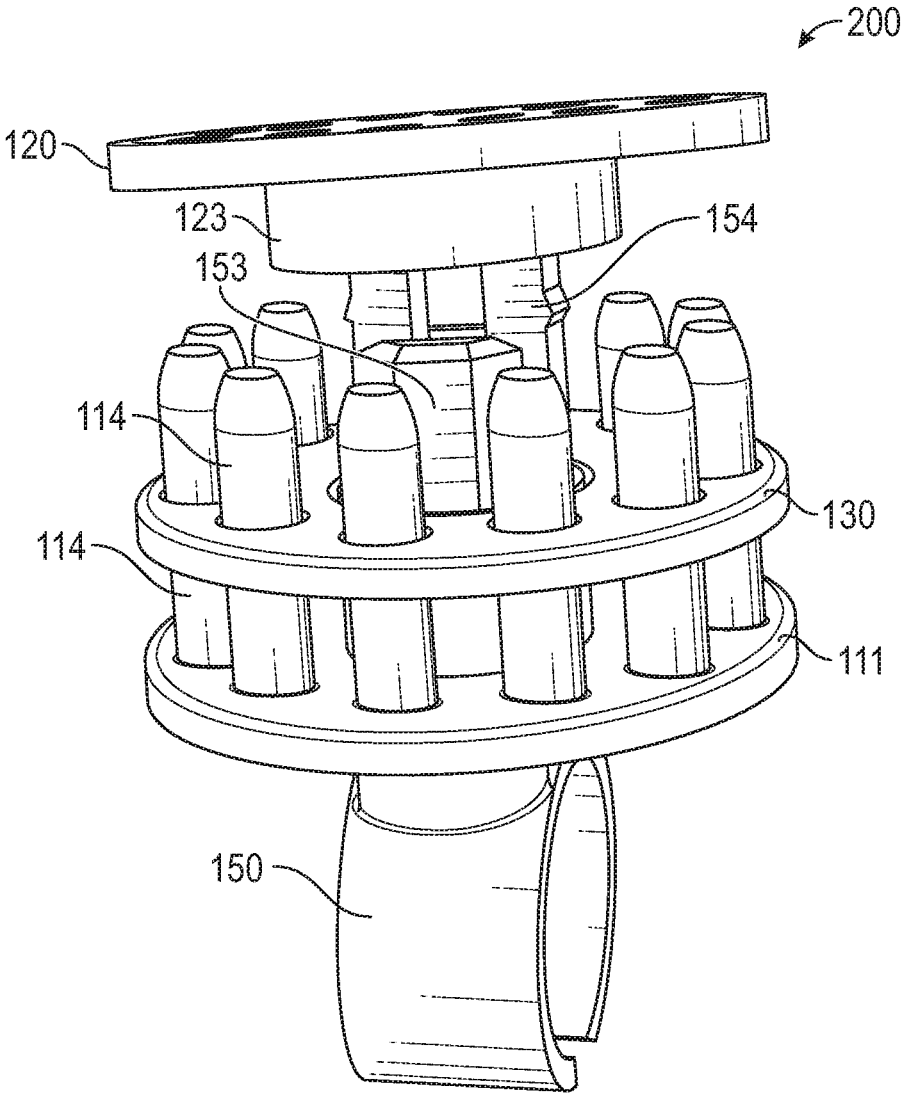

Like knitting ring 100, knitting ring 200 includes finger member 150 and yarn member 105 that includes base member 110 and top plate 120. Base member 110 includes base plate 111, flange 112 forming prong opening 113 and posts 114, while top plate 120 includes prong opening 121 and post openings 122. Unlike in knitting ring 100, yarn member 105 in knitting ring 200 includes a dividing plate 130. Dividing plate 130 is similar to top plate 120 in that it includes a prong opening 121 and post openings 122 that receive posts 114. As best seen in FIG. 2C, prior to coupling top plate 120, posts 114 can be inserted into post openings 122 of dividing plate 130 until a bottom surface of dividing plate 130 contacts surface 112*a* of flange 112. In some embodiments, an inner flange 112*b* can extend from surface 112*a* adjacent prong channel 113 such that surface 112*a* extends around and is recessed from inner flange 112*b*. Prong opening 121 of dividing plate 130 can be shaped and sized to receive inner flange 112*b*.

Top plate 120 of knitting ring 200 may be configured in substantially the same manner as described above with the addition of a flange 123 that extends from bottom surface 120*b*. When top plate 120 is coupled, flange 123 contacts surface 112*a* and/or inner flange 113 to thereby maintain a spacing between dividing plate 130 and top plate 120. Alternatively, flange 123 could be formed on dividing plate 130.

Figure 2E:
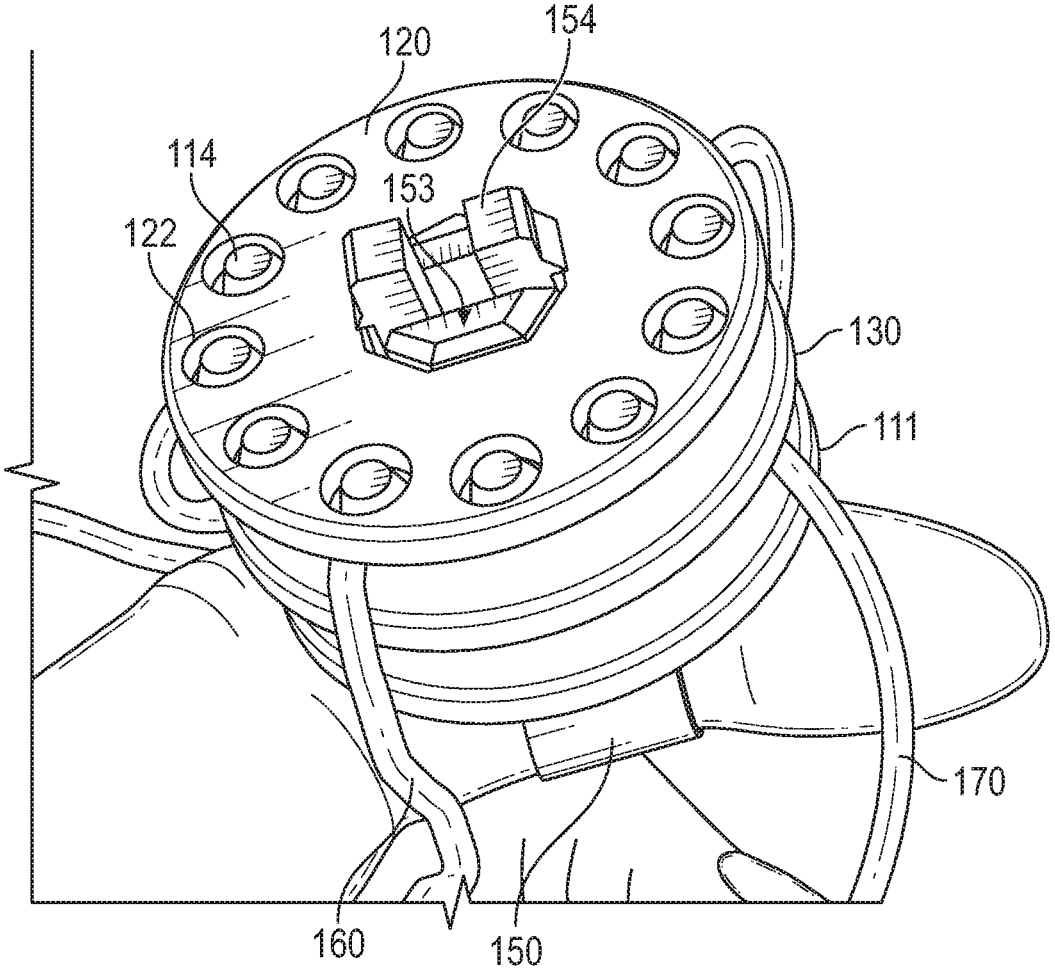

FIG. 2E illustrates knitting ring 200 in use. As shown, strands of yarn 160 and 170 have been routed through yarn member 105. Notably, strand 160 extends between top plate 120 and dividing plate 130 while stand 170 extends between dividing plate 130 and base plate 111. Accordingly, this two-story arrangement of yarn member 105 allows the separate strands of yarn to be isolated. A yarn member 105 having this two-story arrangement could have any suitable shape such as the rectangular shape shown in FIGS. 1A-1D, a square shape, a diamond shape, a hexagonal shape, an oval shape, etc.

In summary, a knitting ring can employ a plurality of spaced-apart posts to apply a tensioning (or frictional) force on strands of yarn. These posts enable the knitter to create a desired amount of tensioning by simply routing the yarn around the posts in an appropriate pattern.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A knitting ring comprising:

a finger member that secures the knitting ring to a knitter's finger; and a yarn member that is coupled to the finger member, the yarn member including a plurality of posts that are arranged in offset rows to thereby allow one or more strands of yarn to be selectively routed around the plurality posts to tension the one or more strands of yarn to a desired degree.

2. The knitting ring of claim 1, wherein the yarn member comprises a base member having a base plate from which the plurality of posts extend.

3. The knitting ring of claim 2, wherein the yarn member comprises a top plate that couples to the base member, the top plate having a plurality of post openings, at least some of the plurality of the posts extending into the plurality of post openings when the top plate is coupled to the base member.

4. The knitting ring of claim 3, wherein the yarn member includes a flange that maintains a spacing between the base plate and the top plate.

5. The knitting ring of claim 4, wherein the flange extends from the base plate, the top plate contacting the flange when the top plate is coupled to the base member.

6. The knitting ring of claim 4, wherein the flange forms a prong channel, the top plate includes a prong opening and the finger member includes one or more prongs, wherein the one or more prongs extend through the prong channel and the prong opening to thereby secure the finger member, the base member and the top plate together.

7. The knitting ring of claim 3, wherein the yarn member comprises a dividing plate that couples to the base member, the dividing plate having a plurality of post openings, at least some of the plurality of posts extending through the plurality of post openings of the dividing plate when the dividing plate is coupled to the base member.

8. The knitting ring of claim 7, wherein the yarn member includes a flange that maintains a spacing between the top plate and the dividing plate.

9. The knitting ring of claim 8, wherein the flange extends from the top plate, the flange contacting the dividing plate when the top plate is coupled to the base member.

10. The knitting ring of claim 2, wherein the finger member is separable from the base member.

11. The knitting ring of claim 1, wherein the plurality of posts have a textured outer surface.

12. A knitting ring comprising:

a finger member that secures the knitting ring to a knitter's finger;

a base member coupled to the finger member, the base member having a base plate and a plurality of posts that extend from the base plate, the plurality of posts being spaced apart to thereby allow one or more strands of yarn to be selectively routed around one or more of the plurality posts to tension the one or more strands of yarn to a desired degree; and a top plate having a plurality of post opening, the plurality of posts extending into the plurality of post openings when the top plate is coupled to the base member.

13. The knitting ring of claim 12, wherein the plurality of posts are arranged in offset rows.

14. The knitting ring of claim 12, further comprising:

a dividing plate having a plurality of post openings, the plurality of posts extending through the plurality of post openings of the dividing plate when the dividing plate is coupled to the base member, the dividing plate being spaced between the base plate and the top plate.

15. The knitting ring of claim 12, wherein the top plate is coupled to the base member via one or more prongs.

16. A knitting ring comprising:

a finger member that secures the knitting ring to a knitter's finger;

a yarn member coupled to the finger member, the yarn member comprising a base plate, a top plate and a plurality of posts that extend between the base plate and the top plate, the plurality of posts being arranged in offset rows on opposing sides of the base plate to thereby allow one or more strands of yarn to be selectively routed around the plurality posts to tension the one or more strands of yarn to a desired degree.

17. The knitting ring of claim 16, wherein the yarn member further comprises a dividing plate that is spaced between the base plate and the top plate, the plurality of posts extending through the dividing plate.

18. The knitting ring of claim 16, wherein the plurality of posts extend from the base plate.

19. The knitting ring of claim 18, wherein the top plate includes a plurality of post openings into which the plurality of posts extend.

20. The knitting ring of claim 16, wherein the yarn member is coupled to the finger member via one or more prongs that extend through the base plate and the top plate, wherein the one or more prongs are configured to enable the yarn member to be oriented in a plurality of rotational positions relative to the finger member.

* * * * *